US009169583B2

(12) United States Patent
Hasegawa et al.

(10) Patent No.: US 9,169,583 B2
(45) Date of Patent: Oct. 27, 2015

(54) WOVEN TAPE FOR SLIDE FASTENER

(75) Inventors: Takayuki Hasegawa, Toyama (JP); Takahiro Asami, Tokyo (JP); Takashi Mori, Tokyo (JP); Tutomu Hamatani, Tokyo (JP); Hideki Sato, Tokyo (JP)

(73) Assignee: YKK Corporation (JP)

( * ) Notice: Subject to any disclaimer, the term of this patent is extended or adjusted under 35 U.S.C. 154(b) by 199 days.

(21) Appl. No.: 13/824,455

(22) PCT Filed: Sep. 28, 2010

(86) PCT No.: PCT/JP2010/066821

§ 371 (c)(1),
(2), (4) Date: Mar. 18, 2013

(87) PCT Pub. No.: WO2012/042595

PCT Pub. Date: Apr. 5, 2012

(65) Prior Publication Data

US 2013/0177734 A1 Jul. 11, 2013

(51) Int. Cl.
*D03D 1/00* (2006.01)
*A44B 19/34* (2006.01)

(52) U.S. Cl.
CPC *D03D 1/00* (2013.01); *A44B 19/34* (2013.01); *A44B 19/346* (2013.01); *Y10T 24/25* (2015.01); *Y10T 428/24008* (2015.01); *Y10T 428/24479* (2015.01); *Y10T 442/30* (2015.04)

(58) Field of Classification Search
CPC ..... D03D 1/00; A44B 19/34; A44B 19/346
USPC ..... 428/99, 156; 24/381; 442/181
See application file for complete search history.

(56) References Cited

U.S. PATENT DOCUMENTS

| | | | | |
|---|---|---|---|---|
| 2,400,924 | A * | 5/1946 | Fite, Jr. | 139/384 B |
| 4,354,532 | A * | 10/1982 | Tsubata | 139/384 B |
| 6,505,652 | B1 | 1/2003 | Matsushima | |
| 2004/0244157 | A1 | 12/2004 | Matsuda | |
| 2007/0089466 | A1 * | 4/2007 | Ikeguchi et al. | 66/195 |
| 2008/0289156 | A1 * | 11/2008 | Lewis et al. | 24/381 |

FOREIGN PATENT DOCUMENTS

| | | | |
|---|---|---|---|
| JP | S49039135B | B | 10/1974 |
| JP | S57037308 | U | 2/1982 |

(Continued)

OTHER PUBLICATIONS

Office Action, Japanese Patent Application No. 2012-536047, mailed Jan. 7, 2014.

(Continued)

*Primary Examiner* — Aaron Austin
*Assistant Examiner* — Jasper Saberi
(74) *Attorney, Agent, or Firm* — Kilpatrick Townsend & Stockton LLP

(57) ABSTRACT

A woven tape for a slide fastener comprising an element mounting portion and a tape main portion, wherein the tape portion includes warp having a fineness of 30-100 dTex and a weaving density of 100-220 yarns/inch (2.54 cm), weft having a fineness of 60-180 dTex and a weaving density of 30-80 yarns/inch (2.54 cm), and a ratio of the number of yarns in the warp constituting a plain weave structure to the total number of yarns in the warp in the tape main portion is at least 40%. The woven tape for a slide fastener has a low weight and yet a high strength.

8 Claims, 5 Drawing Sheets

(56) References Cited

FOREIGN PATENT DOCUMENTS

| | | | |
|---|---|---|---|
| JP | 63-5535 | Y2 | 2/1988 |
| JP | 05-184414 | A | 7/1993 |
| JP | 5-42731 | Y2 | 10/1993 |
| JP | 2006-175129 | A | 7/2006 |

OTHER PUBLICATIONS

International Search Report, PCT Application No. PCT/JP2010/066821, mailed Nov. 30, 2010.

* cited by examiner

WOVEN TAPE FOR SLIDE FASTENER

This application is a national stage application of PCT/JP2010/066821 which is incorporated herein by reference.

FIELD OF THE INVENTION

The present invention relates to a woven tape for slide fasteners. The present invention relates further to a slide fastener chain and a slide fastener provided with the woven tape.

BACKGROUND OF THE INVENTION

Slide fasteners are opening-closing tools widely used not only in articles of daily use such as garments, bags, shoes and sundry goods, but also in articles of industry such as water storage tanks, fishing nets and space suits.

In general, a slide fastener is comprised of three main parts, namely, a pair of long tapes, a number of elements sewed on along with a side edge of each tape and functioning as engaging parts of the fastener, and a slider for controlling the opening and closing of the fastener by engaging and disengaging the elements.

As such tapes for the slide fastener, woven tapes obtained by weaving warp and weft are widely used. The fundamental structure of the woven tape for the slide fastener is shown in FIG. 5. The woven tape is described in FIG. 1 of Japanese Utility Model Publication No. H5-42731 (Patent document 1) and comprised of an element-mounting portion A and a tape main portion B which are formed by weaving warp 2 and weft 3. The element-mounting portion A is the portion on which elements are mounted and the tape main portion B is the portion to be sewed on the body of an article. The elements 1 are mounted on the element-mounting portion A with the mounting yarn 5. Also, the selvage yarn 8 may be provided to the edge of the tape main portion B to prevent fray of the edge.

In the field of woven tape for slide fasteners, problems such as cost reduction, prevention of seam slippage, improvement of tape strength, prevention of puckering, increase in stability of the mounted elements, increase in softness, and enhancement of fashionability have been attached great importance. Various improvements to solve these problems have been proposed.

For example, with the aim of cost reduction, prevention of seam slippage and puckering, and also increase in stability of the mounted elements, the above-cited Japanese Utility Model Publication No. H5-42731 (Patent document 1) discloses a structure wherein the element-mounting portion A is formed as having a densely knitted or woven structure; the tape main portion B is formed by using a multi-filament yarn as a core of at least one of the warp and weft on the surface of which is coated with a synthetic resin; and the interlacing points of the yarns are fused together so that a coarse mesh-like structure is obtained.

For the purpose of providing a fastener tape which can be used for mounting any type of fastener element in a slide fastener and yet looks fashionable, Japanese Patent No. 3618243 (Patent document 2) discloses to form an element-mounting portion by weaving a plurality of soft yarns into the edge portion of a fastener tape in the longitudinal direction, wherein the soft yarn is formed by textured multi-filament yarn made of soft synthetic fibers, and the textured yarn is thicker and bulkier than the warp yarn.

Japanese Patent Public Disclosure No. 2004-351085 (Patent Document 3) aims at providing a fastener tape which has both flexibility and softness and can fit naturally with any cloth having a softness and draping nature during or after sewing on the slide fastener, and yet a sufficient tape strength and engaging strength are attained. To achieve this object, Patent Document 3 discloses that the warp and weft that constitute a fastener tape are both made with multi-filaments, and the fineness of the monofilament for the warp is selected from 1.0-2.0 dTex, and the fineness of monofilament for the weft is selected from 2.0-5.0 dTex.

PRIOR ART DOCUMENTS

Patent Documents

Patent document 1: Japanese Utility Model Publication No. H5-42731

Patent document 2: Japanese Patent No. 3618243

Patent document 3: Japanese Patent Public Disclosure No. 2004-351085

SUMMARY OF THE INVENTION

Problems to be Solved by the Invention

As mentioned above, although various technical improvements have been proposed with respect to the woven tapes for slide fasteners, there has been little technical improvement, as far as the present inventors know, which aims at reducing the weight of the slide fasteners. The light weight is important in portable windbreakers used in outdoor sports such as running, cycling and trekking, or laces for women and cardigans for infants, and hence it will be advantageous if the weight of the slide fastener is reduced, while maintaining the strength.

Therefore, an object of the present invention is to provide a woven tape for a slide fastener, having both light weight and strength. Another object of the invention is to provide a slide fastener provided with such a woven tape. A further object of the invention is to provide an article on which the present fastener is sewed.

Means for Solving the Problem

Usually, the fineness and the weaving density of yarns which constitute a woven tape for a slide fastener (hereinafter called "fastener tape") are such that the warp has a fineness of 150-170 dTex and a weaving density of 70-110 yarns/inch (2.54 cm), while the weft has a fineness of 300-350 dTex and a weaving density of 40-50 yarns/inch (2.54 cm). The weft yarn is generally thicker than the warp yarn for retaining the strength. The reason for using yarns of such specification is that they are superior in terms of securing strength, productivity, production cost and the like.

In the early stage, the inventors had tried to reduce the weight not by changing the fineness but by reducing the weaving density. However, it was found that the fastener tape not only looked loose and rough, giving inferior appearance, but also gave insufficient strength.

Subsequently, the inventors tried to use thinner yarns, intending to reduce the weight of the fastener tape. However, it was found that the thin yarns have induced various problems such as reduced strength, reduced texture, increased seam slippage, inferior outlook due to loose and rough appearance, reduction in stability of the mounted elements.

Under the circumstances, the present inventors conducted extensive studies and have discovered that a fastener tape of light weight and high strength can be obtained by using thinner yarns, namely, yarns having the fineness lower than the conventional yarns, while increasing the weaving density, and using a higher ratio of plain weave structure.

The present invention, which has been completed on the basis of the above-mentioned findings, provides, in one aspect, a woven tape for a slide fastener comprising an element-mounting portion (A) and a tape main portion (B), wherein said tape main portion (B) includes warp (101) having a fineness of 30-100 dTex and a weaving density of 100-220 yarns/inch(2.54 cm), weft (102) having a fineness of 60-180 dTex and a weaving density of 30-80 yarns/inch (2.54 cm), and a ratio of the number of yarns in the warp (101) constituting a plain weave structure to the total number of yarns in the warp (101) in the tape main portion (B) is at least 40%.

According to one embodiment of the present invention, the element-mounting portion (A) comprises bunches of paralleled warp yarns each bunch having at least two warp yarns (103), wherein a single warp yarn (104) having a shifted interlacing points is disposed inbetween adjacent bunches of paralleled warp yarns.

According to another embodiment of the present invention, the element-mounting portion (A) includes warp (101) having a fineness of 60-100 dTex and a weaving density of 60-100 yarns/inch (2.54 cm), and weft (102) having a fineness of 140-180 dTex and a weaving density of 30-70 yarns/inch (2.54 cm).

According to a further embodiment of the present invention, the ratio of the number of yarns in the warp (101) constituting a plain weave structure to the total number of yarns in the warp (101) in the tape main portion (B) is at least 60% but at most 80%.

According to a further embodiment of the present invention, an area density of the tape is 140-160 g/m$^2$.

According to a further embodiment of the present invention, the thickness of the tape main portion (B) is 0.2-0.4 mm.

According to a further embodiment of the present invention, the element-mounting portion (A) has a tape thickness larger than the tape main portion.

The present invention, in another aspect, provides a slide fastener provided with the woven tape for a slide fastener according to the present invention.

The present invention, in a further aspect, provides an article on which the slide fastener according to the present invention is sewed.

Effects of the Invention

According to the present invention, a light-weight and yet strong woven tape for a slide fastener is provided. Also, as the slide fastener of the present invention employs yarns thinner than those for the conventional slide fasteners, the advantage of improved softness of the tape is obtained.

MODE FOR CARRYING OUT THE PRESENT INVENTION

In the following, embodiments of the present invention will be described in detail. However, it should be understood that the present invention is not restricted to these embodiments but various modifications are possible within the concept of the present invention.

Figure 1A:
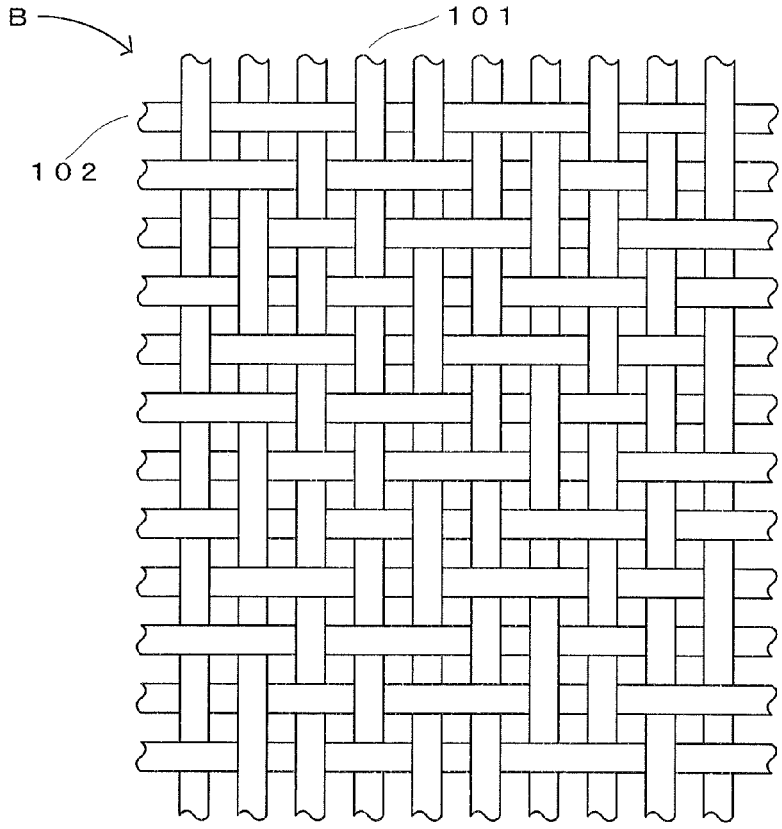
FIG. 1A is a partial enlarged view of the tape main portion (B) of the fastener tape according to one embodiment of the present invention.
Figure 1B:
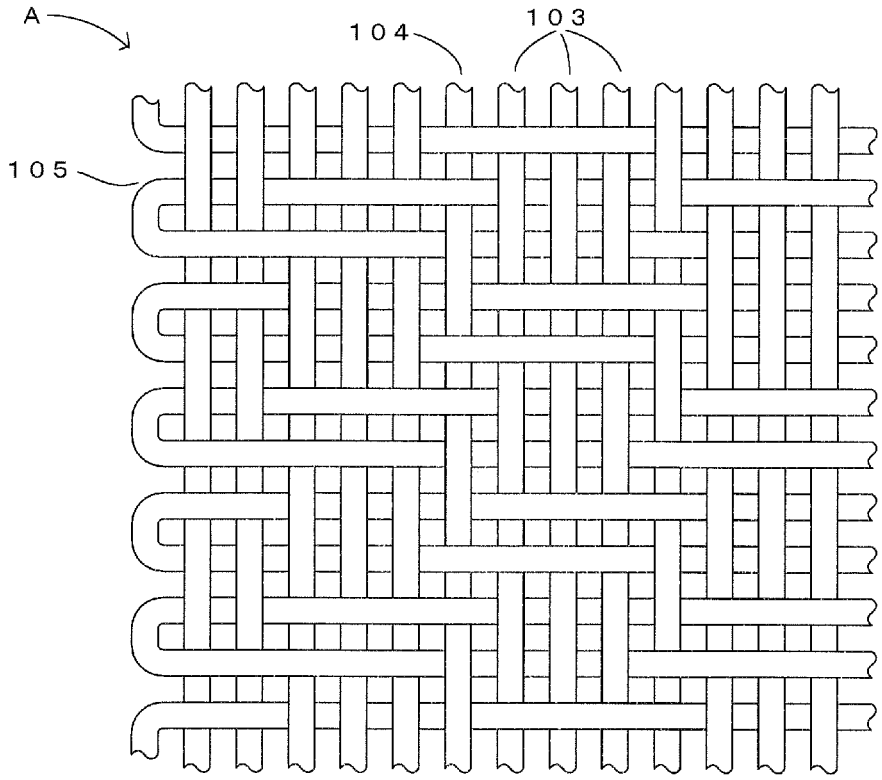
FIG. 1B is a partial enlarged view of the element-mounting portion (A) of the fastener tape according to one embodiment of the present invention.

FIG. 1A and FIG. 1B respectively depict a partial enlarged view of the tape main portion (B) and the element-mounting portion (A) of one embodiment of the fastener tape (100) according to the present invention.

<1. Tape Main Portion>

1-1. Fineness and Weaving Density

The basics of the fastener tape of the present invention are that yarns constituting the tape main portion (B) have a low fineness and are woven with a high weaving density. This structure plays a basic role for making the fastener tape lighter while retaining the strength. Since yarns with a low fineness, in other words, thin yarns tend to increase the cost for production as well as the percentage of defectives, they have been rather avoided heretofore as the material for fastener tapes. The feature of the present invention resides in that such thin yarns are used, in contradiction to such prior knowledge.

Specifically, the warp has a fineness of 30-100 dTex and a weaving density of 100-220 yarns/inch (2.54 cm), the weft has a fineness of 60-180 dTex and a weaving density of 30-80 yarns/inch (2.54 cm). The yarn may be based on monofilaments or multi-filaments. A single yarn may be formed with a monofilament or with a multifilament made by bundling a plurality of monofilaments. Or it may also be formed with a plurality of multifilaments. For example, a single yarn of 500 dTex is formed with two bundles of multifilaments each having 50 monofilaments of 5 dTex. Depending on the weaving machine adopted, the weft yarn is generally formed with a pair of multifilaments.

Referring to FIG. 1A, the tape main portion (B) comprises the warp (101) having a fineness of 84 dTex and a weaving density of 175 yarns/inch (2.54 cm), the weft (102) having a fineness of 167 dTex and a weaving density of 52 yarns/inch (2.54 cm). The weft (102) is formed with a pair of multifilaments each having a fineness of 84 dTex.

1-2. Ratio of Plain Weave Structure

The fastener tape according to the present invention is further characterized in that the ratio of the plain weave structure is higher than that of the conventional fastener tape. The plain weave structure is such that the warp yarn and the weft yarn are alternately interlacing from one after another. Since the interlacing points of the warp and weft yarns are so many, the strength and the durability are superior but the texture is insufficient. Therefore, in the conventional fastener tape, the ratio of the number of the yarns in the warp forming the plain weave yarns per total number of the yarns in the warp was as low as 0-40%.

In contrast, in the present invention, because thin yarns are employed as above-mentioned, the tape is rich in softness and the texture is not substantially impaired even if the ratio of the plain weave structure is increased. Accordingly, it becomes possible to enhance the strength by increasing the ratio of the plain weave structure, while the debasing of the texture is simultaneously suppressed. Thus, in the fastener tape of the present invention, the yarns constituting the tape main portion are so selected that the ratio of the number of the yarns in the warp constituting the plain weave structure to the total number of yarns in the warp is at least 40%, preferably at least 50% and more preferably at least 60%, thereby to secure the strength.

In order to obtain a good balance between the strength and the texture, it is preferred to blend other types of weaving structure for enhancing the texture other than the plain weave structure, rather than to use the plain weave structure at 100%. Since the plain weave structure requires longer yarns than the other types of structure, the total weight increases. Accordingly, it is preferred to blend a structure other than the plain weave structure from the standpoint of lower weight fastener tape. Specifically, among the yarns constituting the tape main portion, the yarns in the warp constituting the plain weave structure is preferably 90% or less, preferably 80% or less, based on the total number of yarns in the warp. The other types of weaving structure for enhancing the texture other than the plain weave structure are those having a warp yarn straddling two or more weft yarns such as twill weave structure and satin weave structure. Examples of the twill weave structure are 2/2 twill (warp yarn /weft yarn) in which a warp yarn crosses over two weft yarns and then crosses under next two weft yarns. Or other twill weave structures such as 2/1, 1/2, 1/3, 3/1 etc. may also be cited.

In the embodiment of the tape main portion (B) of FIG. 1A, the number of the warp yarns (101) constituting the tape main portion (B) is 10 and the number of the warp yarn (101) constituting the plain weave structure is 6 and accordingly the ratio of the plain weave structure is 60%. The remainder is 2/2 twill weave. The other area which is not depicted in this figure is composed of the same weave structure and thus the ratio of the warp yarns (101) constituting the plain weave structure to the total number of the warp yarns (101) in the tape main portion (B) is about 60%. The ratio of the warp yarns (101) constituting the plain weave structure to the total number of the warp yarns (101) in the tape main portion (B) is not restricted to the depicted example. If the number of the warp yarns (101) constituting the tape main portion (B) is 10 and the number of the warp yarn (101) constituting the plain weave structure is 5, then the ratio of the plain weave is about 50%. If the number of the warp yarns (101) constituting the plain weave is 4, the ratio of the plain weave structure is about 40%. Further, the number of the warp yarns (101) constituting the plain weave structure may be suitably selected depending on the change of the tape width. For example, if the tape width (the size in the horizontal direction of FIG. 1A) is 11-13 mm, the ratio of the number of the warp yarns (101) constituting the plain weave structure to the total number of the warp yarns (101) in the main tape portion (B) is 60% or more. On the other hand, in case where a tape width is 14-17 mm, the ratio of the warp yarns constituting the plain weave structure to the total number of the warp yarns (101) in the tape main portion can be at least 50% or at least 40% by increasing the number of the warp yarns constituting a weaving structure other than the plain weave structure without increasing the number of the warp yarns constituting the plain weave structure.

1-3. Tape Thickness

Figure 3:
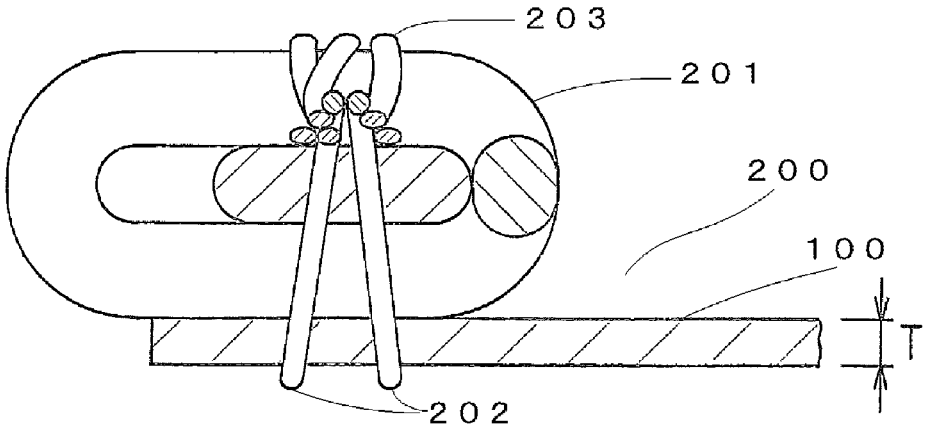
FIG. 3 is a cross sectional view of FIG. 2 in the arrow direction.

By defining the fineness, the weaving density and the weaving structure as above, in one embodiment of the fastener tape according to the present invention, the thickness of the tape main portion can be 0.2-0.4 mm. The main portion (B) depicted in FIG. 1A has a thickness of 0.3 mm. FIG. 3 illustrates a fastener stringer (200) in which fastener elements (201) are mounted on the fastener tape. The symbol "T" in FIG. 3 indicates the thickness of the tape.

The measurement of tape thickness is carried out according to the method defined in JIS-L-1096.

1-4. Material of the Yarns

The material for the yarns used for the slide fastener according to the present invention may be polyester, nylon, polypropylene and acrylic or the like which have been widely used for slide fasteners, but the polyester is the most preferred as it has a good sewing property and a high material strength, etc.

<2. Element-Mounting Portion>

2-1. Weave Structure Using Paralleled Yarn

From the standpoint of producing an integral fastener tape, the weft yarn used in the element-mounting portion is usually the same yarn as that used in the tape main portion and the weaving density is also the same. On the other hand, with respect to the warp yarn, these factors are much flexible and accordingly it is not necessary to use the same fineness and weaving density in the element-mounting portion as those in the tape main portion. However, from the aspect of compatibility of both light weight and strength of slide fastener, which is the object of the present invention, it is preferred that the fineness of yarns and the weaving density in the element-mounting portion are within the ranges of the fineness of yarns and the weaving density as described with respect to the yarns for the tape main portion, and that the material for the yarns is polyester.

In this case, since the yarns constituting the element-mounting portion becomes as thin as the yarns for the tape main portion, the thickness of the fastener tape becomes correspondingly small, which causes a problem that dimensional stability and mounting strength of the mounted elements is reduced. Therefore, it is desired to make the element-mounting portion thicker so as to prevent the gap from generating between the element and the fastener tape. One way of making the element-mounting portion thicker is to use bunches of paralleled warp yarns in the element-mounting portion, each bunch having at least two warp yarns. Although it is preferred for larger thickness of the element-mounting portion to increase the number of the paralleled yarns, an excessive number of the paralleled yarns will in turn cause seam slippage or will make the tape excessively thick. Accordingly, it is preferred to use 2-4, preferably 3, paralleled yarns in a single bunch of warp yarns. In addition, it is desirable that a single warp yarn having shifted interlacing points is disposed inbetween adjacent bunches of paralleled warp yarns, whereby an excessive bulging and displacement of the weaving structure is prevented.

In the element-mounting portion, in order to secure the necessary thickness, it is preferred to adopt a weaving structure in which a warp yarn straddles at least two weft yarns, such as 2/2, 2/1, 1/2, 1/3, 3/1 structures rather than to use 1/1 (warp yarn/weft yarn) structure in which a warp yarn crosses over a weft yarn and then crosses under a next weft yarn.

Referring to FIG. 1B, the element-mounting portion (A) includes bunches of paralleled warp yarns of 2/2 weaving structure wherein three warp yarns (103) are paralleled, and a single warp yarn (104) having a 2/2 weaving structure and shifted interlacing points which is disposed in between the adjacent bunches of warp yarns. The warp (104) has a fineness of 84 dTex and a weaving density of 175 yarns/inch (2.54 cm), while the weft (105) has a fineness of 167 dTex and a weaving density of 50 yarns/inch (2.45 cm).

It should be noted that the element-mounting portion is not required to use the yarn of the same fineness and material as that used in the tape main portion, but may have different fineness and material from the tape main portion. However, from the standpoint of compatibility of light weight and strength, it is preferred that they are within the ranges of fineness and weaving density as explained in the section of the tape main portion and that the yarn material is polyester.

2-2. Tape Thickness

In one embodiment of the fastener tape according to the present invention, the thickness of the element-mounting portion may be larger than the tape main portion by adopting the weaving structure using paralleled yarns as described above. The thickness may be typically thicker by 1.1-1.2 times, and may be 2.2-4.8 mm, for example.

<3. Properties of the Fastener Tape>

3-1. Area Density

As described above, since the fastener tape according to the present invention has been devised to reduce its weight, it has typically 50-70 wt % of the conventional fastener tape. More specifically, the area density of the fastener tape according to the present invention may be 140-160 g/m$^2$.

3-2. Strength

Since the fastener tape according to the present invention has a structure as above-described, it has a sufficient strength even though it employs thinner yarns. When a crosswise tensile strength test according to JIS-S-3015 was conducted on a fastener chain which has coiled fastener elements attached to the fastener tape (100) as illustrated in FIG. 1A and FIG. 1B, the value of 530N was obtained. This value is comparable to the fastener tape using the conventional thicker yarns.

<4. Slide Fastener Chain>

Fastener stringers are formed by mounting elements on the element-mounting portion of a fastener tape. Engaging the right and left stringers together becomes a fastener chain. There is no restriction to the type of the elements. For example, a single piece element as represented by a metal element and a plastic element molded on a tape by injection, a continuous element as represented by a coiled plastic element may be mentioned. Among them, the coiled plastic element is preferred because it is light in weight and flexible.

Figure 2:
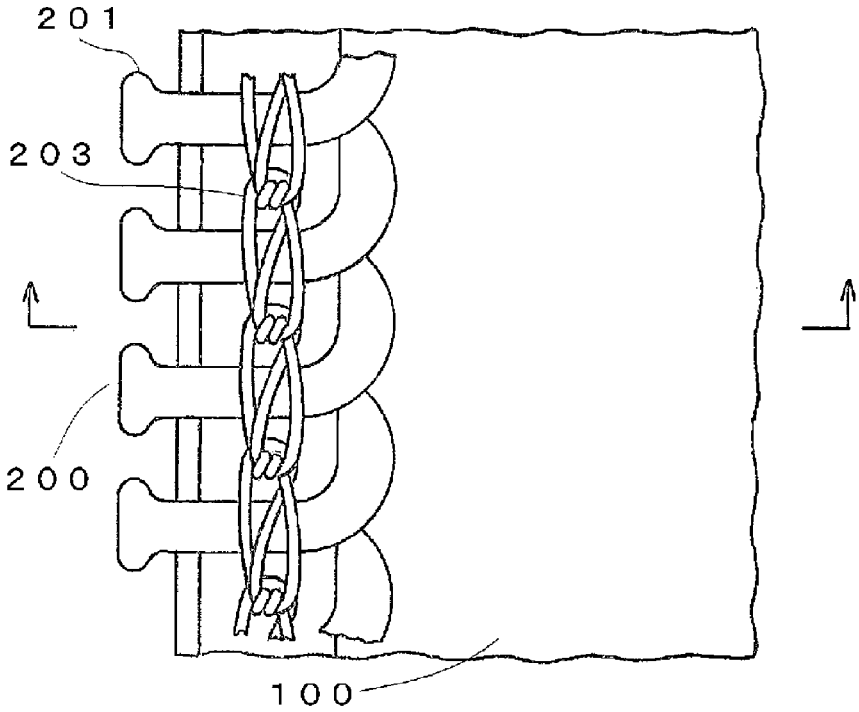
FIG. 2 is a front view of the fastener stringer according to one embodiment of the present invention.

FIG. 2 is a schematic view of a fastener stringer (200) which is made by sewing a coiled element (201) on the element-mounting portion (A) with sewing yarns (202, 203). FIG. 3 is a cross sectional view of FIG. 2 in the direction of the arrows. Although there is no special restriction on the type of the sewing yarns (202, 203), sewing yarns having 160-350 dTex are preferred from the standpoints of reducing the weight of the fastener tape and also enhancement of softness. When these thin yarns are used as sewing yarns, to supplement the mounting strength of the elements, it is preferable to use a plurality of needle yarns. For example, it is preferred to employ cover stitch sewing which uses plural needle yarns and a single loop yarn. In the embodiment of FIGS. 2 and 3, the coiled element (201) is mounted on the element-mounting portion (A) with two needle yarns (202) and one loop yarn (203).

Figure 4:
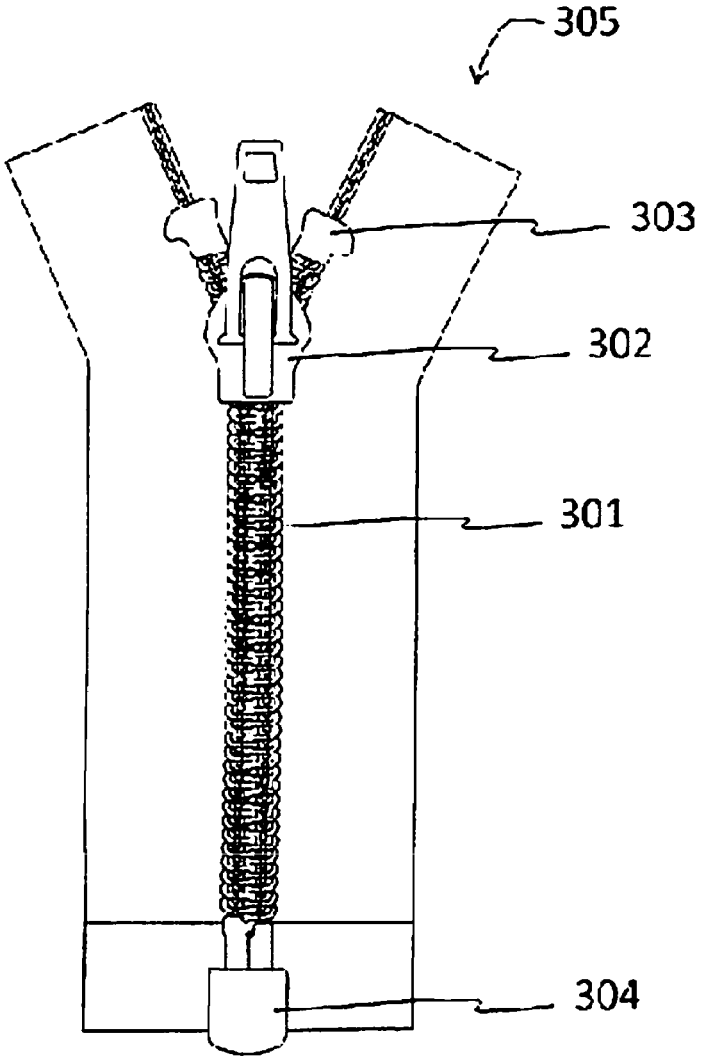
FIG. 4 is a front view of the slide fastener according one embodiment of the present invention.
Figure 5:
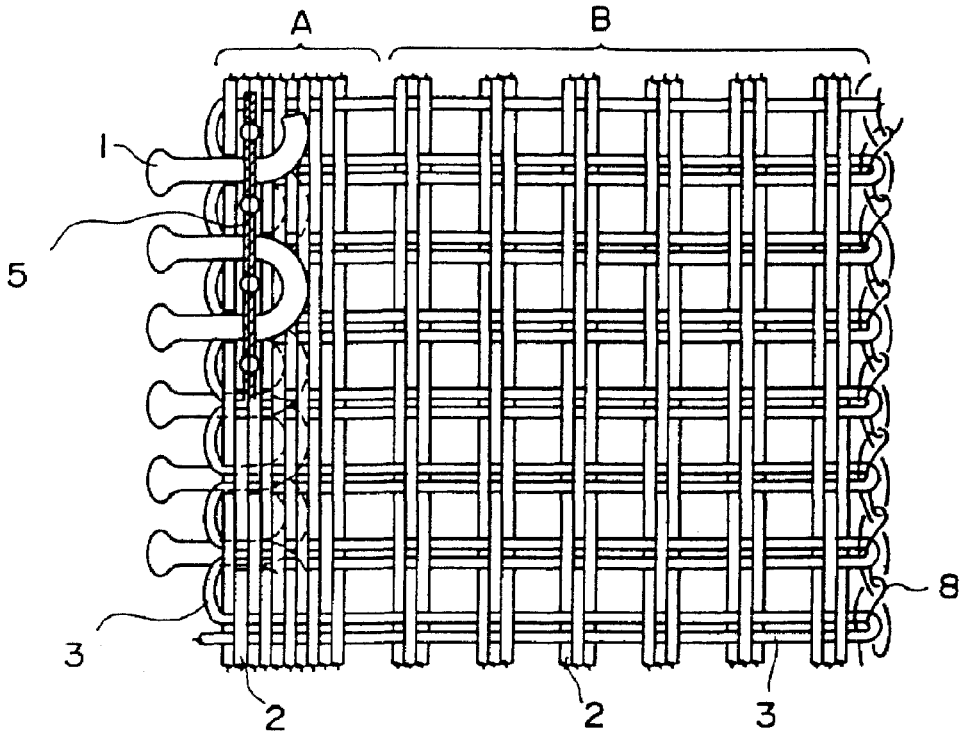
FIG. 5 is a view showing a structure of the woven tape for the slide fastener depicted in FIG. 1 of Japanese Utility Model Publication No. H5-42731 (Patent document 1)

The slide fastener (305) such as illustrated in FIG. 4 is completed by mounting the slider (302) and the top end and bottom end stops (303) and (304) on the slide fastener chain 301. The slide fastener according to the present invention can be sewed on various articles and used as an opening/closing tool. It can be conveniently used with articles such as laces, cardigans, window breakers, etc.

EXPLANATION OF THE SYMBOLS

100 Fastener tape
101 Warp yarn in tape main portion
102 Weft yarn in tape main portion
103 Parelleled yarn in the element-mounting portion
104 Warp yarn in the element-mounting portion
105 Weft yarn in the element-mounting portion
200 Fastener stringer
201 Element
202 Needle yarn
203 loop yarn
A Element-mounting portion
B Tape main portion
301 Slide fastener chain
302 Slider
303 Top end stop
304 Bottom end stop

What is claimed is:

1. A woven tape for a slide fastener comprising an element-mounting portion and a tape main portion, wherein said tape main portion includes warp having a fineness of 30-100 dTex and a weaving density of 100-220 yarns/inch (2.54 cm), weft having a fineness of 60-180 dTex and a weaving density of 30-80 yarns/inch (2.54 cm), and a ratio of the number of yarns in the warp constituting a plain weave structure to the total number of yarns in the warp in the tape main portion is at least 40%.

the element-mounting portion comprises bunches of paralleled warp yarns each bunch having at least two warp yarns such that the element-mounting portion has a tape thickness larger than the tape main portion, and a single warp yarn having shifted interlacing points is disposed inbetween adjacent bunches of paralleled warp yarns.

2. The woven tape according to claim 1, wherein the element-mounting portion includes warp having a fineness of 60-100 dTex and a weaving density of 60-100 yarns/inch (2.54 cm), and weft having a fineness of 140-180 dTex and a weaving density of 30-70 yarns/inch (2.54 cm).

3. The woven tape according to claim 1, wherein the ratio of the number of yarns in the warp constituting a plain weave structure to the total number of yarns in the warp in the tape main portion is at least 60% but at most 80%.

4. The woven tape according to claim 1, wherein an area density of the tape is 140-160 g/m$^2$.

5. The woven tape according to claim 1, wherein the thickness of the tape main portion is 0.2-0.4 mm.

6. A slide fastener provided with the woven tape according to claim 1.

7. An article on which the slide fastener of claim 6 is sewed.

8. The woven tape according to claim 1, wherein the thickness of the tape main portion is 0.2-0.4 mm and the element-mounting portion has a tape thickness 1.1-1.2 times as large as the tape main portion.

* * * * *

UNITED STATES PATENT AND TRADEMARK OFFICE

CERTIFICATE OF CORRECTION

PATENT NO. : 9,169,583 B2
APPLICATION NO. : 13/824455
DATED : October 27, 2015
INVENTOR(S) : Takayuki Hasegawa et al.

It is certified that error appears in the above-identified patent and that said Letters Patent is hereby corrected as shown below:

On the title page, in item (57), in column 2, in "Abstract", line 1-2, delete "element mounting" and insert -- element-mounting --, therefor.

In the Specification:

In column 3, line 7, delete "yarns/inch(2.54 cm)," and insert -- yarns/inch (2.54 cm), --, therefor.

In column 3, line 63, delete "invention." and insert -- invention; --, therefor.

In column 4, line 3, delete "1)" and insert -- 1). --, therefor.

In column 8, line 8, delete "Parelleled" and insert -- Paralleled --, therefor.

In the Claims:

In column 8, line 27, in claim 1, delete "and a" and insert -- a --, therefor.

In column 8, line 30, in claim 1, delete "40%." and insert -- 40%, --, therefor.

Signed and Sealed this
Ninth Day of August, 2016

Michelle K. Lee

Michelle K. Lee
*Director of the United States Patent and Trademark Office*